US007934298B1

(12) United States Patent
Ghazvini

(10) Patent No.: US 7,934,298 B1
(45) Date of Patent: May 3, 2011

(54) MEMORIALS FOR DECEASED INDIVIDUALS

(76) Inventor: Nasser Ghazvini, Arlington, VA (US)

( * ) Notice: Subject to any disclaimer, the term of this patent is extended or adjusted under 35 U.S.C. 154(b) by 0 days.

(21) Appl. No.: 12/659,424

(22) Filed: Mar. 9, 2010

Related U.S. Application Data

(63) Continuation-in-part of application No. 11/907,301, filed on Oct. 11, 2007, now abandoned.

(51) Int. Cl.
*A61G 17/00* (2006.01)

(52) U.S. Cl. ..... 27/1; 40/124.5

(58) Field of Classification Search ..... 27/1; 40/124.5, 40/722, 725; 206/37; D99/5; 428/913.3, 428/542.4; 220/504
See application file for complete search history.

(56) References Cited

U.S. PATENT DOCUMENTS

| | | | | |
|---|---|---|---|---|
| 1,233,605 | A | 7/1917 | Ridley | |
| 2,009,724 | A | 7/1935 | Bircher | |
| 3,167,844 | A | 2/1965 | Bachofner | |
| 4,199,848 | A | 4/1980 | Kohnert | |
| 4,324,026 | A | 4/1982 | Craft | |
| 5,379,499 | A | 1/1995 | Jackson | |
| 5,694,676 | A | 12/1997 | Lambesis et al. | |
| 5,987,720 | A | 11/1999 | Yamamoto | |
| 6,735,831 | B1 | 5/2004 | Greiwe et al. | |
| 7,082,653 | B1 | 8/2006 | Sueppel | |
| 7,096,546 | B2 | 8/2006 | Poirier | |
| 7,562,423 | B2 * | 7/2009 | Pryd-Kakuk | 27/1 |
| 7,861,385 | B1 * | 1/2011 | Meyer | 27/1 |
| 2004/0205007 | A1 | 10/2004 | Curtis et al. | |
| 2005/0005409 | A1 * | 1/2005 | Elnatan | 27/1 |
| 2006/0207075 | A1 | 9/2006 | Davis | |

* cited by examiner

*Primary Examiner* — William L. Miller
(74) *Attorney, Agent, or Firm* — Swift Law Office; Stephen Christopher Swift

(57) ABSTRACT

A book-shaped or rectangular container for the cremated remains or belongings of a deceased individual, that may be placed on a bookshelf. A picture of the decedent, and/or a written description of him or her and his or her life may appear on or be stored within the container. Public or private libraries may have bookshelves holding the containers, as an alternative to traditional tombs and cemeteries. The containers are hermetically sealed if they contain ashes of the deceased. The pictures and/or written descriptions may be permanently bonded on or removably retained to the surface of the container, or stored in a memory card. The containers may be used for the memorialization of pets as well as people.

20 Claims, 17 Drawing Sheets

MEMORIALS FOR DECEASED INDIVIDUALS

CROSS REFERENCE TO RELATED APPLICATION

This application is a Continuation-In-Part of Regular Utility patent application Ser. No. 11/907,301, filed Oct. 11, 2007, now abandoned, which is incorporated herein by reference.

BACKGROUND OF THE INVENTION

1. Field of the Invention

The present invention relates to memorials for deceased individuals.

2. Description of the Prior Art

There have long been containers for the ashes of dead persons, but none that are suitably configured to be placed like a book or compact disk on a library shelf.

U.S. Pat. No. 4,324,026, issued on Apr. 13, 1982, to William K. Craft, discloses a cremation urn with a compartment for objects of memorabilia. The compartment has a drawer that may be opened to view the objects. The present invention is distinguishable, in that it is a rectangularly shaped container that may be placed on a library shelf, and memorabilia can be displayed on its surface.

U.S. Pat. No. 5,379,499, issued on Jan. 10, 1995, to Robert L. Jackson, discloses a cremation urn, having a first container for the ashes of a deceased person, and a second concealed container for memorabilia. Again, the present invention is distinguishable, in that it is a rectangularly shaped container that may be placed on a library shelf, and memorabilia can be openly displayed on its surface.

U.S. Pat. No. 5,987,720, issued on Nov. 23, 1999, to William Shigeru Yamamoto, discloses a portable tomb for resurrection from mummified tissue DNA. Mummified tissue, an epitaph, memorabilia, and a label are embedded in plastic. It does not disclose a rectanglularly shaped container that may be placed on a library shelf, as in the present invention.

U.S. Pat. No. 6,735,831, issued on May 18, 2004, to John Greiwe et al., discloses a cremation remains container with memorialization features. It is a box-shaped container, rather than a rectangular container designed to fit like a book or compact disc on a library shelf, as in the present invention. The display of pictures and written memorials on a single surface of the container is not disclosed, as in the present invention.

None of the above inventions and patents, taken either singly or in combination, is seen to describe the instant invention as claimed.

SUMMARY OF THE INVENTION

The present invention is a book-shaped or rectangular container for the cremated remains or belongings of a deceased individual, and information about the individual, which I call the "LIFEBOOK", that may be placed on a library shelf as an alternative to traditional tombs and cemeteries. A picture of the decedent, and/or a written description of him or her and his or her life may appear on the container. As the ashes may be kept in a very compact space, the invention saves space and land, and can be used in high rise buildings. It is also more sanitary than traditional burial, as it will not contaminate underground water. Finally, it may cause a huge psychological shift in the death process, as it will bring death one step closer to life and living people, and will make this ultimate destination less painful. Deceased persons may be housed in library shelves that I call a "LIFERARY", with facilities such as children's playgrounds, coffee and flower shops, etc., making it a live place, rather than the dead, lonely, painful atmosphere of cemeteries.

Accordingly, it is a principal object of the invention to provide an alternative to traditional burial.

It is another object of the invention to provide a means of preserving the cremated remains of deceased persons that is sanitary and conserves space and land.

It is a further object of the invention to provide a new means of memorializing deceased individuals.

Still another object of the invention is to provide a means for memorializing companion animals that is an alternative to pet cemeteries.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The first and second preferred embodiments of the present invention are a book shaped container holding the actual ashes of a dead person after cremation, thus replacing a traditional tomb.

Figure 1:
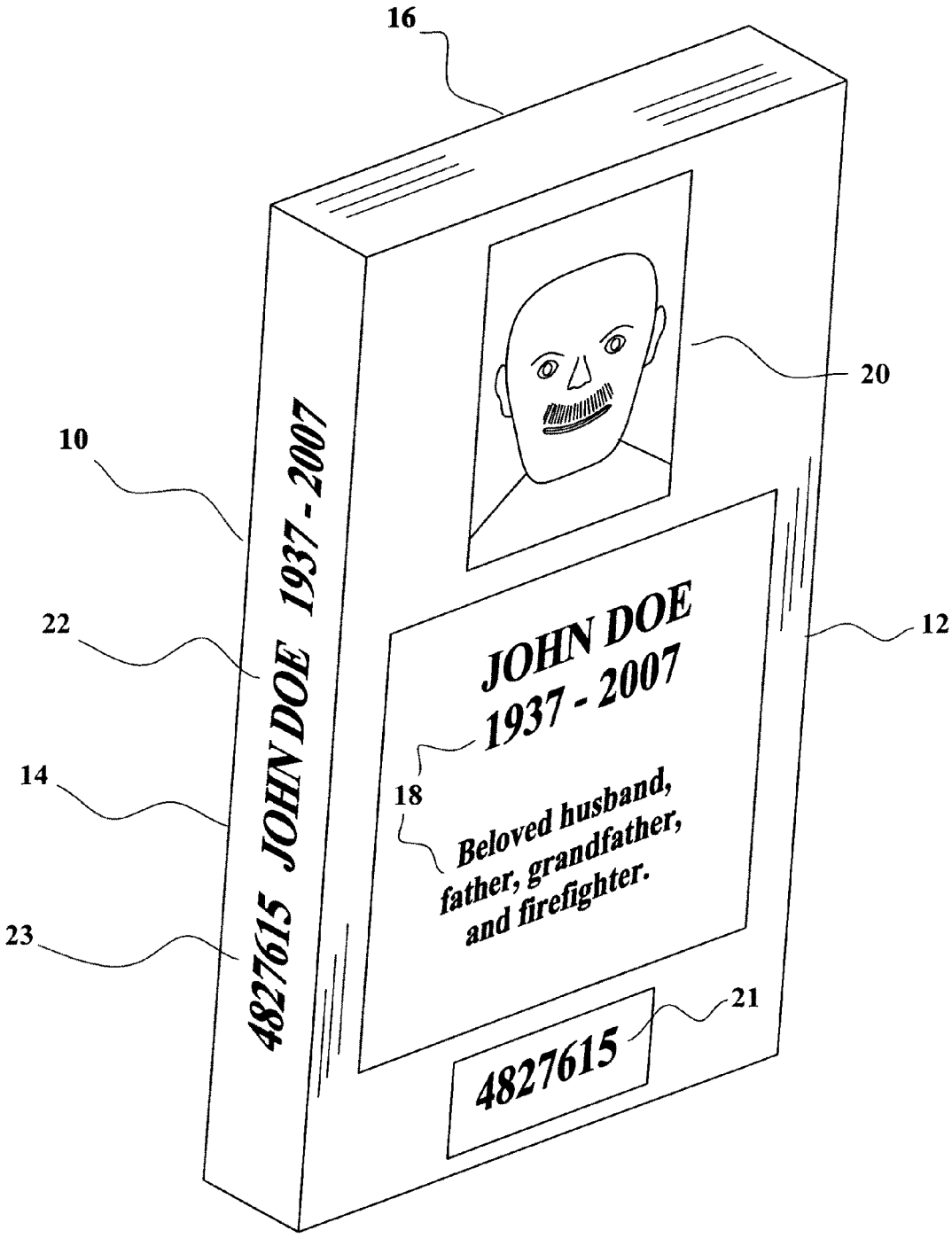
FIG. 1 is a perspective view of the first preferred embodiment of the invention.

FIG. 1 is a perspective view of the first preferred embodiment of the invention, which is a generally rectangular box shaped container 10, showing the front surface 12, the left side surface 14 (corresponding to the spine of a book), and the top surface 16. All or part of the front surface is a display area, containing memorials that are written memorials 18 or pictures 20, and preferably both. The written memorials may be descriptions of the deceased person and/or descriptions of his or her life. The pictures may be photographs, paintings, drawings, etchings, engravings, etc. There may be a serial number 21 and 23, which could be indexed in a library catalog. Optionally, indicia 22 such as the name of the deceased person and the years of his birth and death may appear on the left side surface. As in most books, the length and height will generally be substantially greater than the width. In the first preferred embodiment, the vertical height is greater than the horizontal length.

Figure 2:
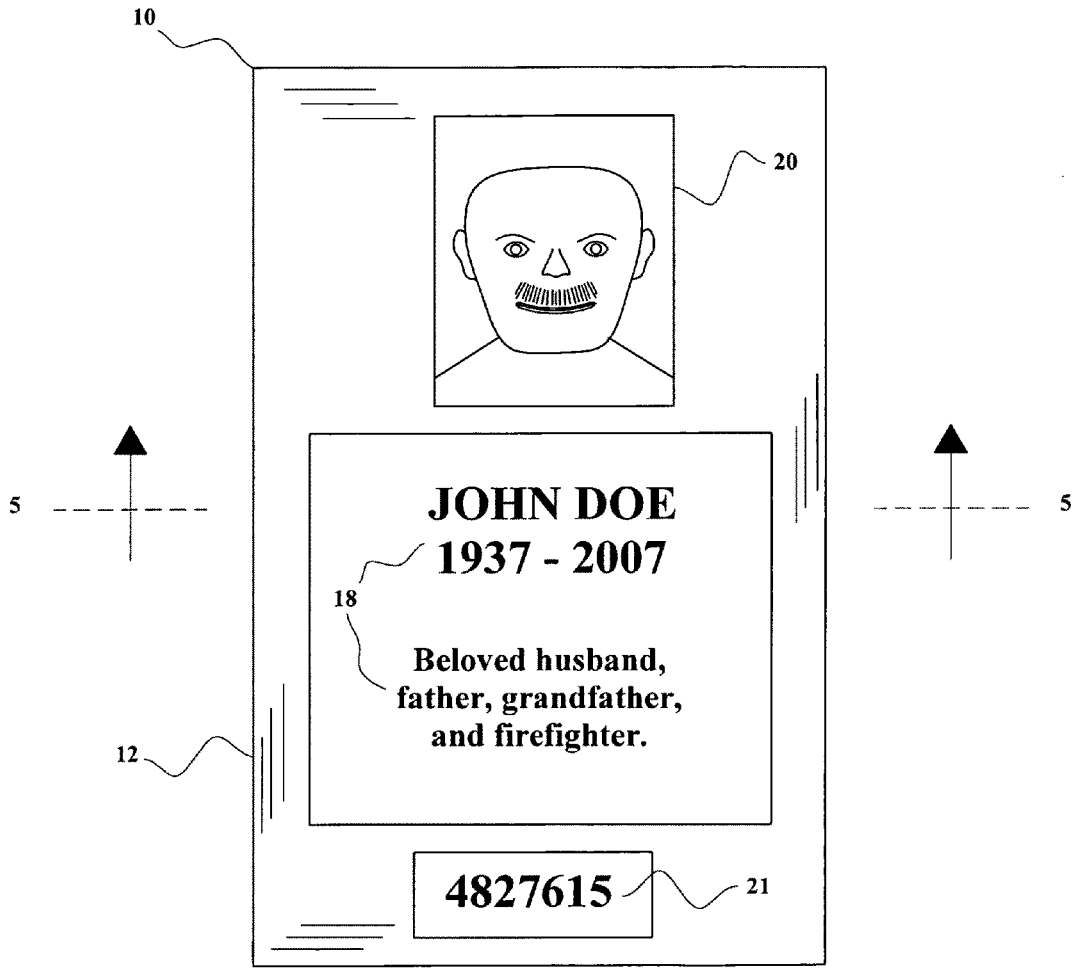
FIG. 2 is a front elevational view of the first preferred embodiment of the invention.

FIG. 2 is a front elevational view of the first preferred embodiment. The rear view will be the same, but may not include memorials.

Figure 3:
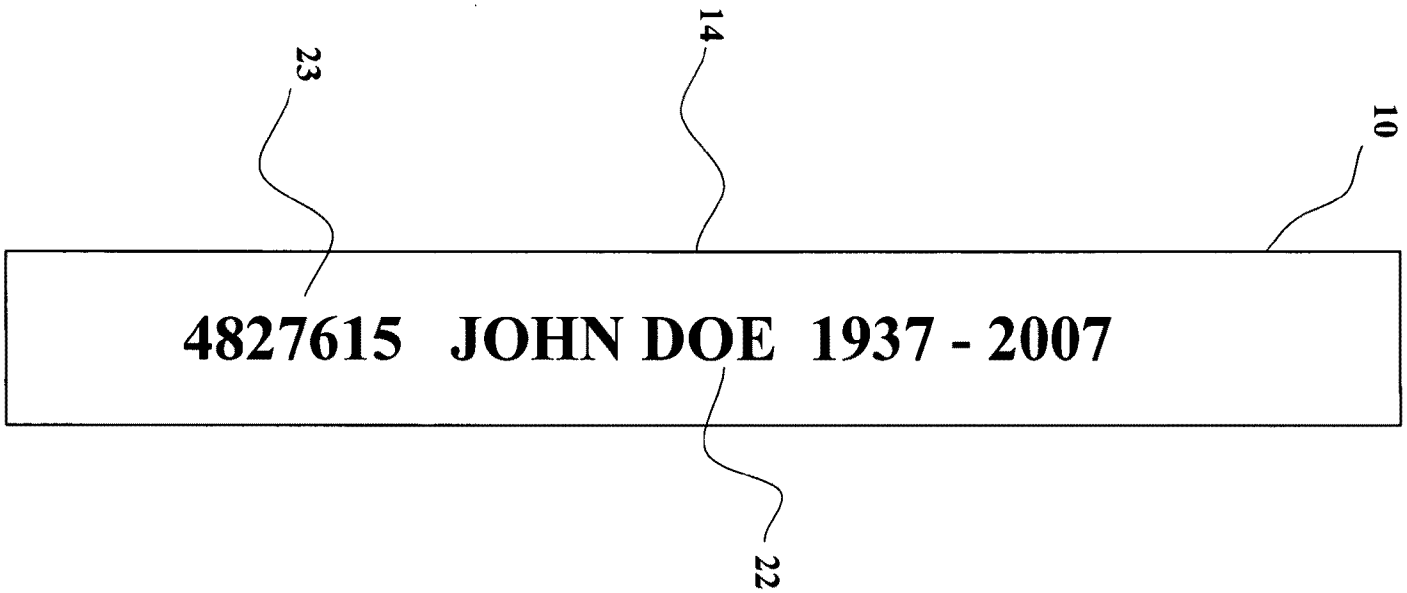
FIG. 3 is a left side elevational view of the first preferred embodiment of the invention.

FIG. 3 is a left side elevational view of the first preferred embodiment. The right side elevational view will be the same, but may not include indicia.

Figure 4:
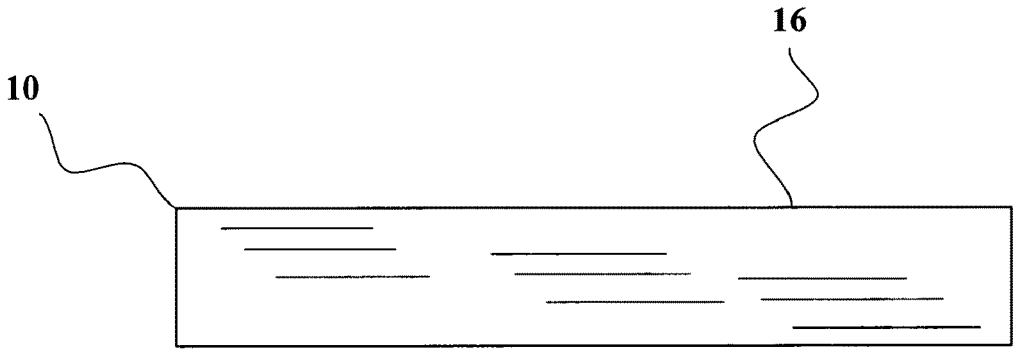
FIG. 4 is a top view of the first preferred embodiment of the invention.

FIG. 4 is a top view of the first preferred embodiment. The bottom view will be the same.

Figure 5:
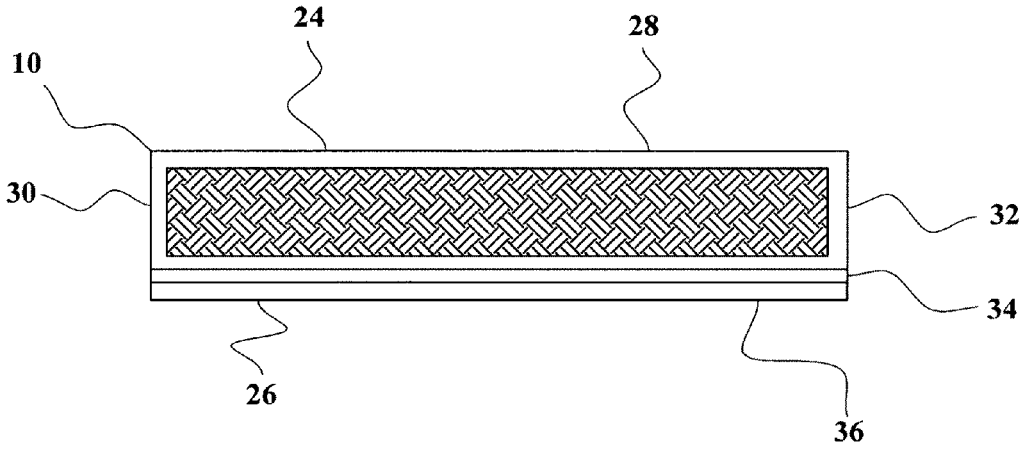
FIG. 5 is a sectional view of the first preferred embodiment of the invention, drawn along lines 5-5 of FIG. 2.

FIG. 5 is a sectional view of the first preferred embodiment drawn along lines 5-5 of FIG. 2, showing the ashes 24, contained by the front wall 26, rear wall 28, left side wall 30, and right side wall 32 (and also by a top wall and bottom wall that are not shown in the drawings). Preferably, the container is air tight, water proof, and hermetically sealed to prevent damage to the cremated remains. The memorials may be affixed to or printed on sheet 34, which is covered by transparent sheet 36. The memorials and sheet 34 may be either permanently bonded to the front surface of the container, or they may be removably retained to the front surface, if it is desired that it be possible to change them. The transparent sheet may be glass or durable plastic that will not degrade with age.

Figure 6:
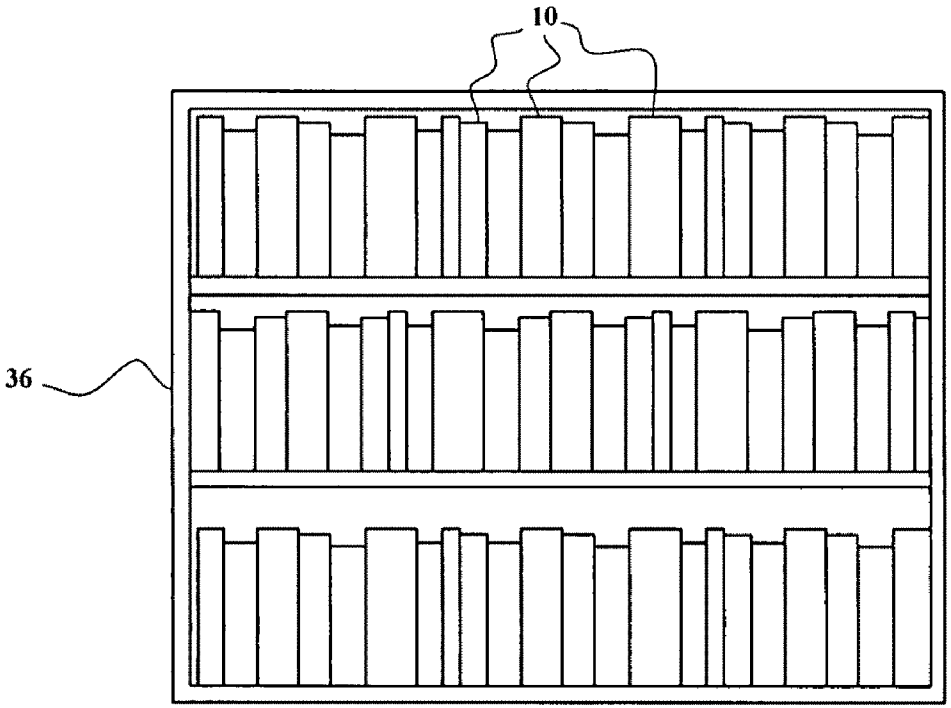
FIG. 6 is a front view of a bookshelf utilizing the preferred embodiments of the invention.

FIG. 6 is a front view of a bookshelf 36 holding multiple versions of the container 10. The bookshelf may hold only the containers, or they may be interspersed with traditional books. The bookshelf with the containers acts as a substitute for a traditional cemetery. There may be many such bookshelves in a library. The library may be a public library, or a private library for a family or other group.

Figure 7:
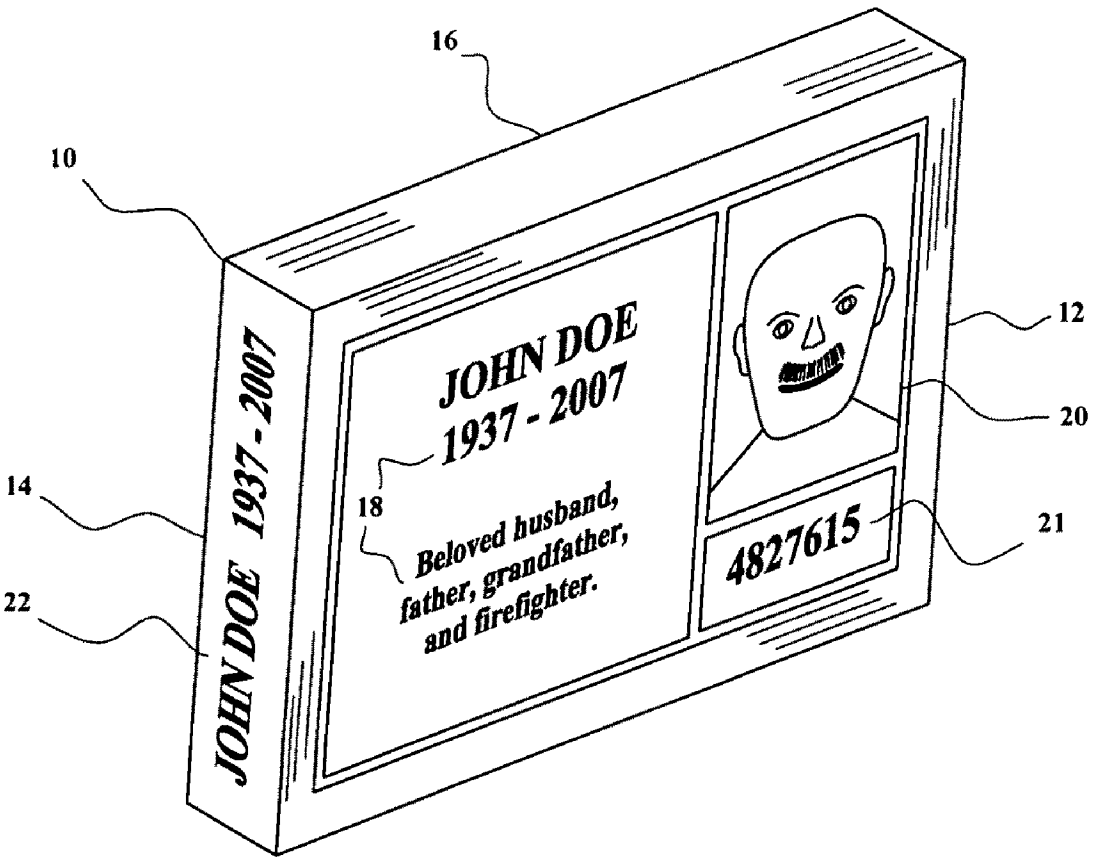
FIG. 7 is a perspective view of the second preferred embodiment of the invention.
Figure 8:
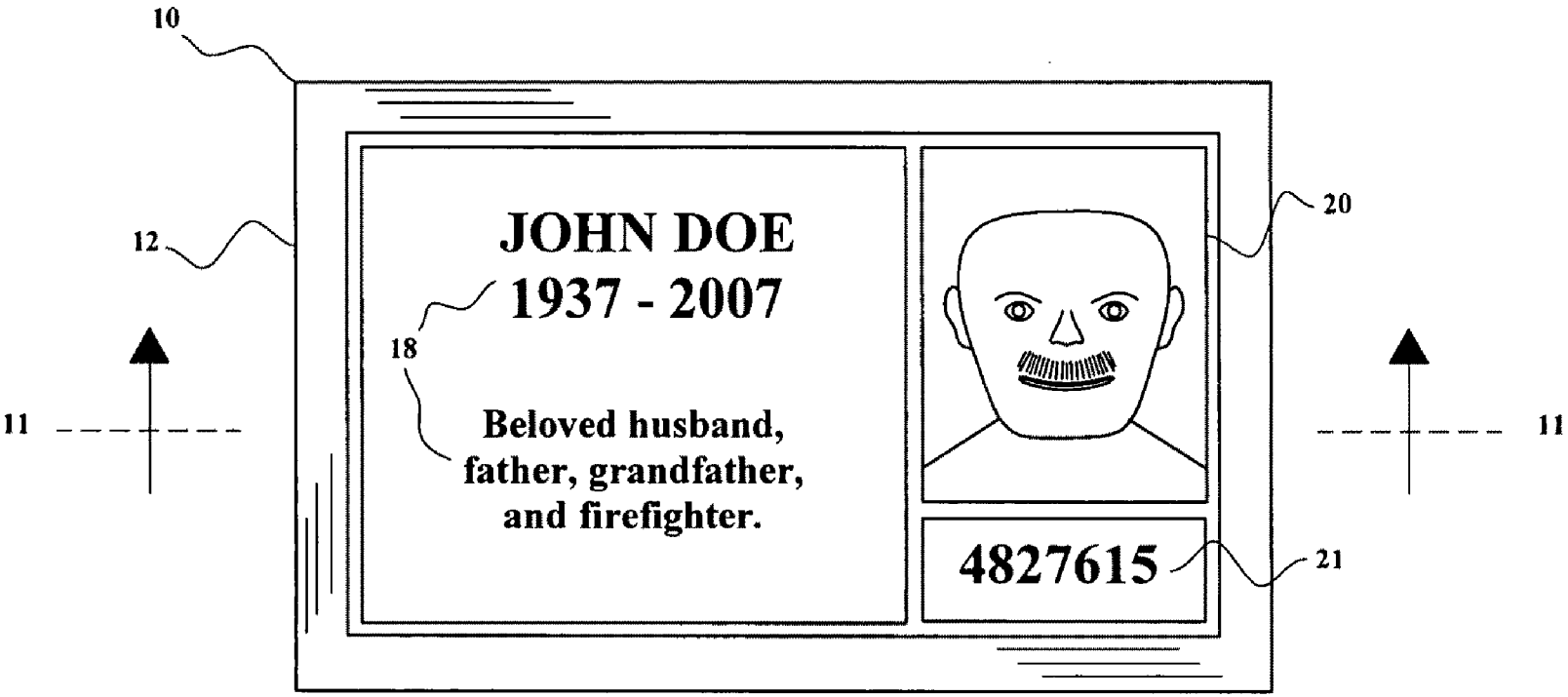
FIG. 8 is a front elevational view of the second preferred embodiment of the invention.
Figure 9:
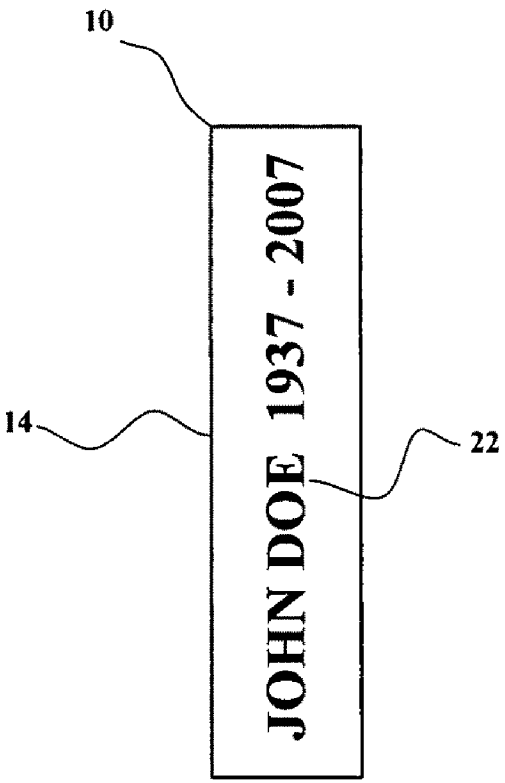
FIG. 9 is a left side elevational view of the second preferred embodiment of the invention.
Figure 10:
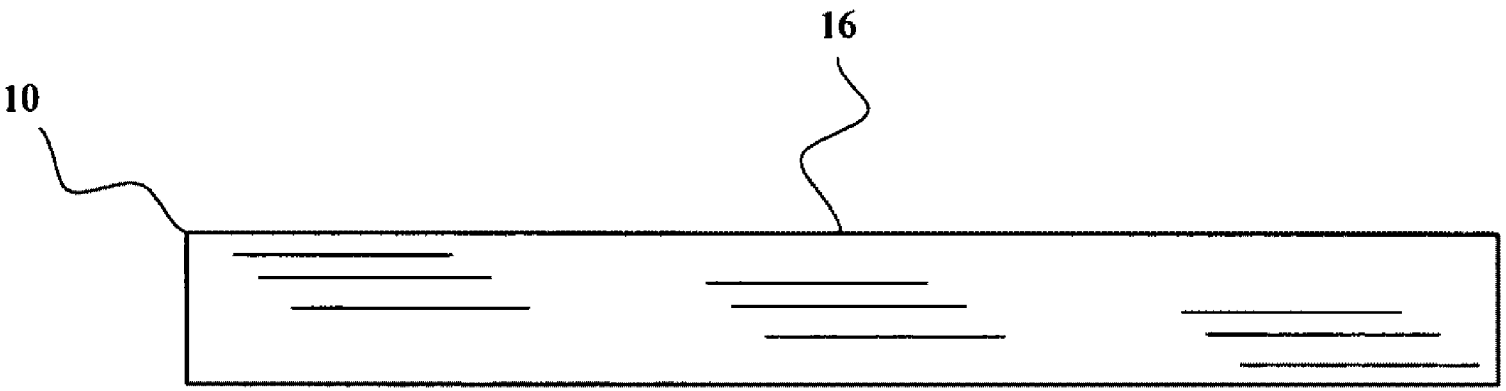
FIG. 10 is a top view of the second preferred embodiment of the invention.
Figure 11:
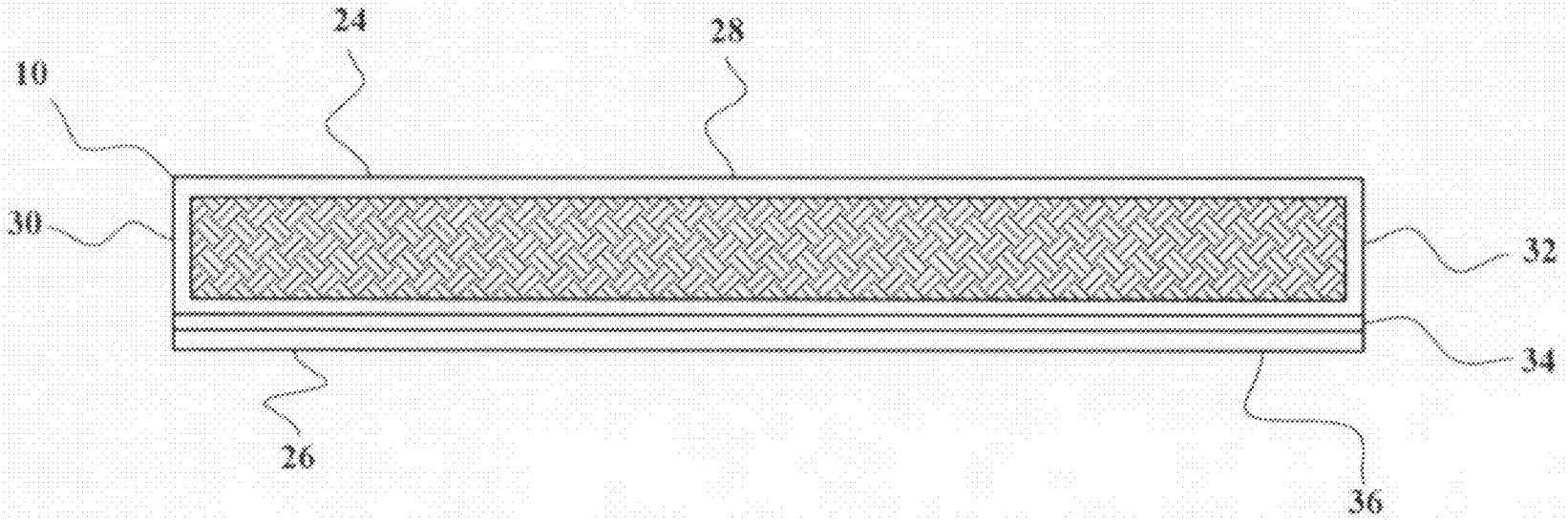
FIG. 11 is a sectional view of the second preferred embodiment of the invention, drawn along lines 11-11 of FIG. 8.

The second preferred embodiment is similar to the first preferred embodiment, except that the horizontal length is greater that the vertical height. FIG. 7 is a perspective view of the second preferred embodiment of the invention. FIG. 8 is a front elevational view of the second preferred embodiment of the invention. FIG. 9 is a left side elevational view of the second preferred embodiment of the invention. FIG. 10 is a top view of the second preferred embodiment of the invention. FIG. 11 is a sectional view of the second preferred embodiment of the invention, drawn along lines 11-11 of FIG. 8.

Besides being an alternative to traditional cemeteries for people, pet owners may wish to use the invention as a substitute for pet cemeteries. The invention would function in essentially the same way for deceased companion animals as for deceased humans.

The invention encompasses a method including the following steps:

cremating the remains of a deceased individual;

placing the resulting ashes in a book-shaped container;

sealing the container;

placing memorials including written memorials and/or pictures in a display area on the surface of the container; and placing the container on a bookshelf.

Figure 12:
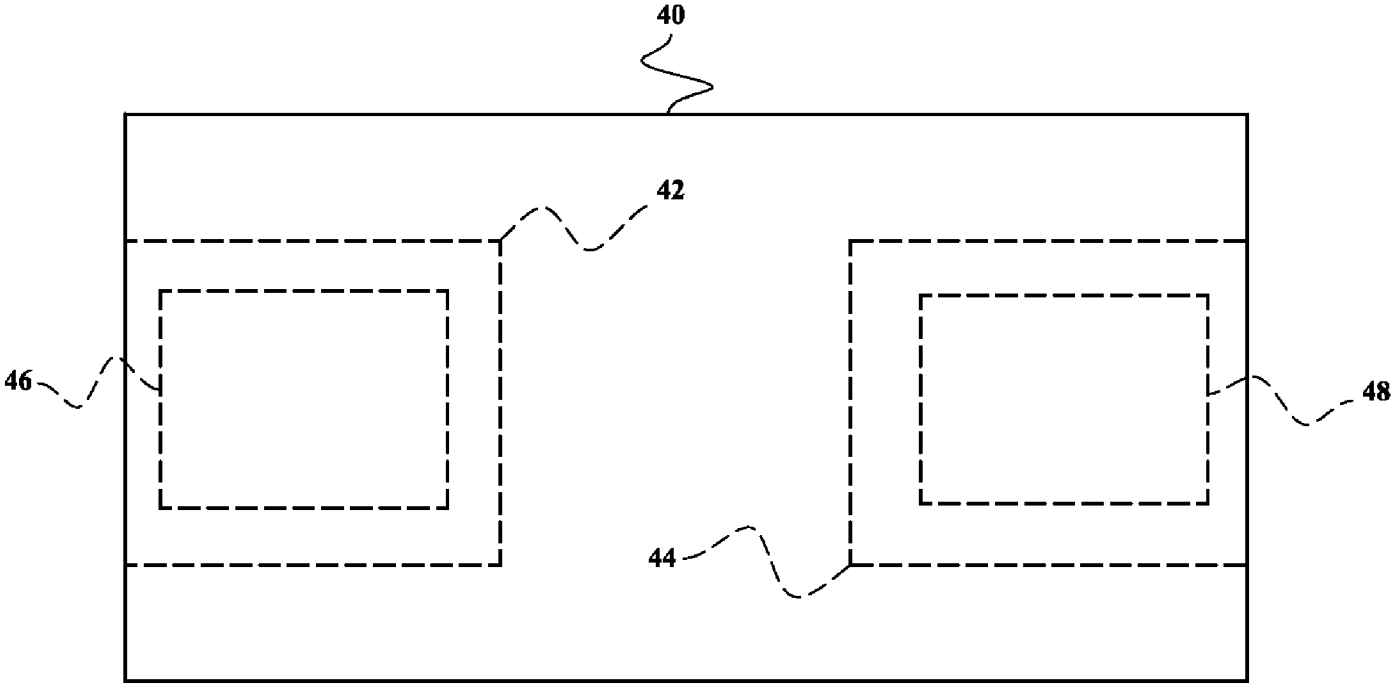
FIG. 12 is a top view of the third preferred embodiment of the invention, showing the memory card and remains module inserted into the base.

The third preferred embodiment of the present invention is a memorial card and memorial data bank. The memorial data bank is composed of three parts, shown in a top view in FIG. 12. Each part has a memorial identification number ("MIN") internally recorded and/or imprinted on its surface.

The first part is the base 40, which is thin and rectangular, and preferably is roughly the size of a credit card. The front and/or back external surfaces of the card may be imprinted with one or more pictures of the deceased, an obituary, or other information about the deceased, as shown in FIG. 2. The base has a first internal rectangular cavity 42 and a second internal rectangular cavity 44.

The second part is a memory card 46 (or memory stick module). It may hold 32 gigabytes or more of data. It can be removably retained within the first internal rectangular cavity of the base. The memory card can be plugged into a port in a computer to retrieve the information about the deceased individual. The memory card may contain pictures or movies in digital format. The huge amount of memory can record everything about the person, from data, to pictures, and even movies of the person when they were alive.

The third part is the remains module 48, which can be removably retained within the second internal rectangular cavity of the base. The remains module may contain actual ashes of the deceased individual, or one or more samples of his or her belongings. The remains module should be sealed. The major part of the deceased individual's remains should be given to his or her family (e.g., ashes in an urn) for preservation. The final disposition of the remains should be done according the decedent's wishes and/or by family decision.

Figure 13:
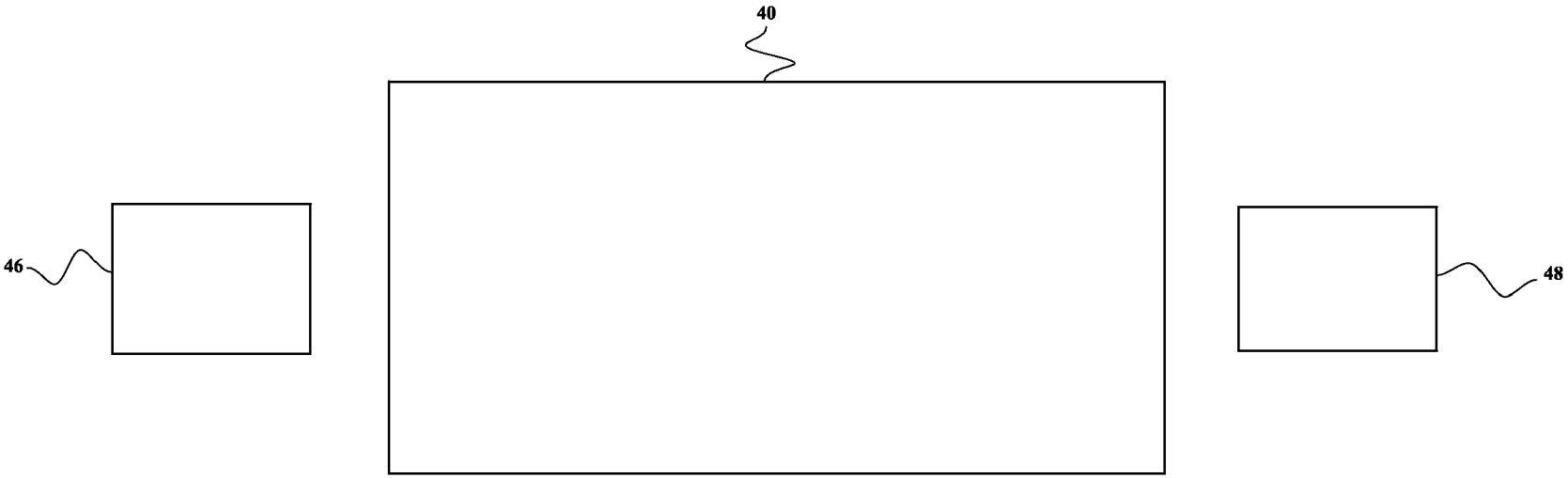
FIG. 13 is a top view of the third preferred embodiment of the invention, showing the memory card and remains module removed from the base.
Figure 14:
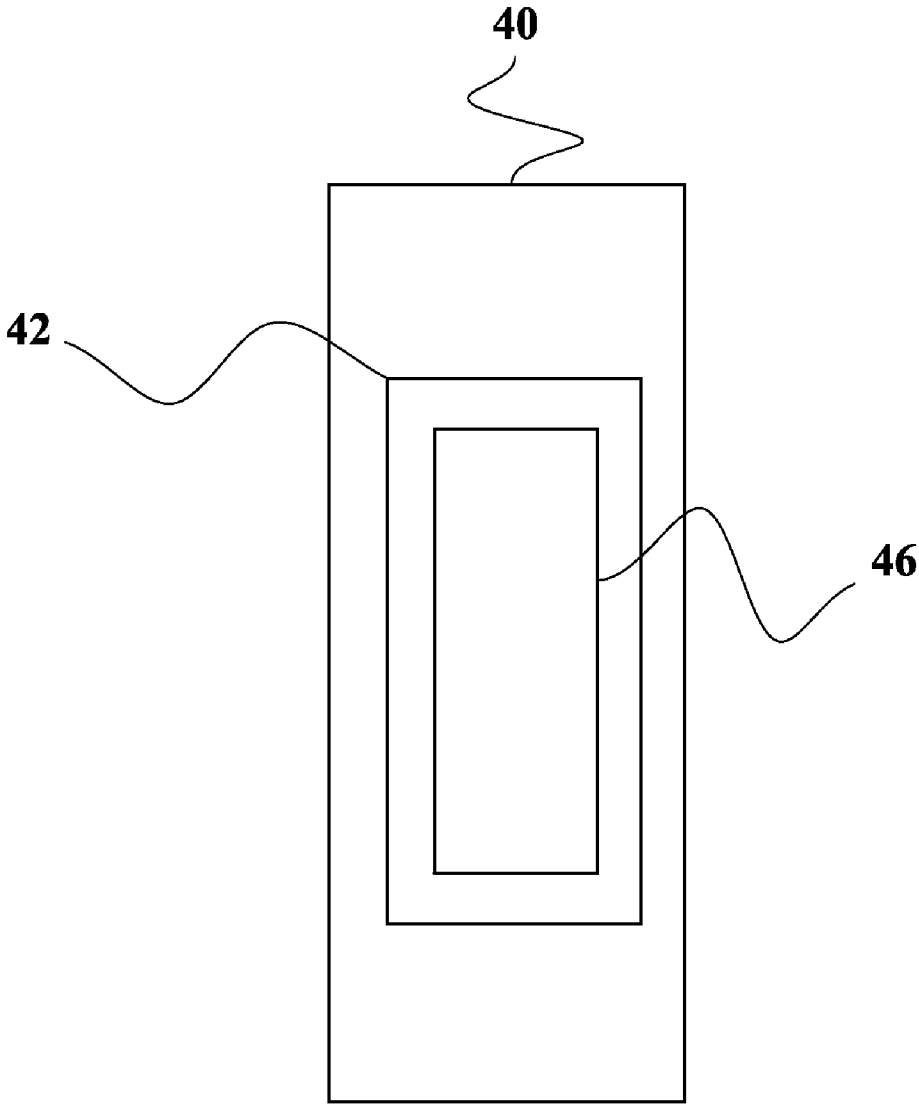
FIG. 14 is a left side elevational view of the third preferred embodiment of the invention.

FIG. 13 is a top view of the third preferred embodiment with the memory card and the remains module removed from the base. FIG. 14 is a left side elevational view of the third preferred embodiment, with a right side elevational view being similar.

Figure 15:
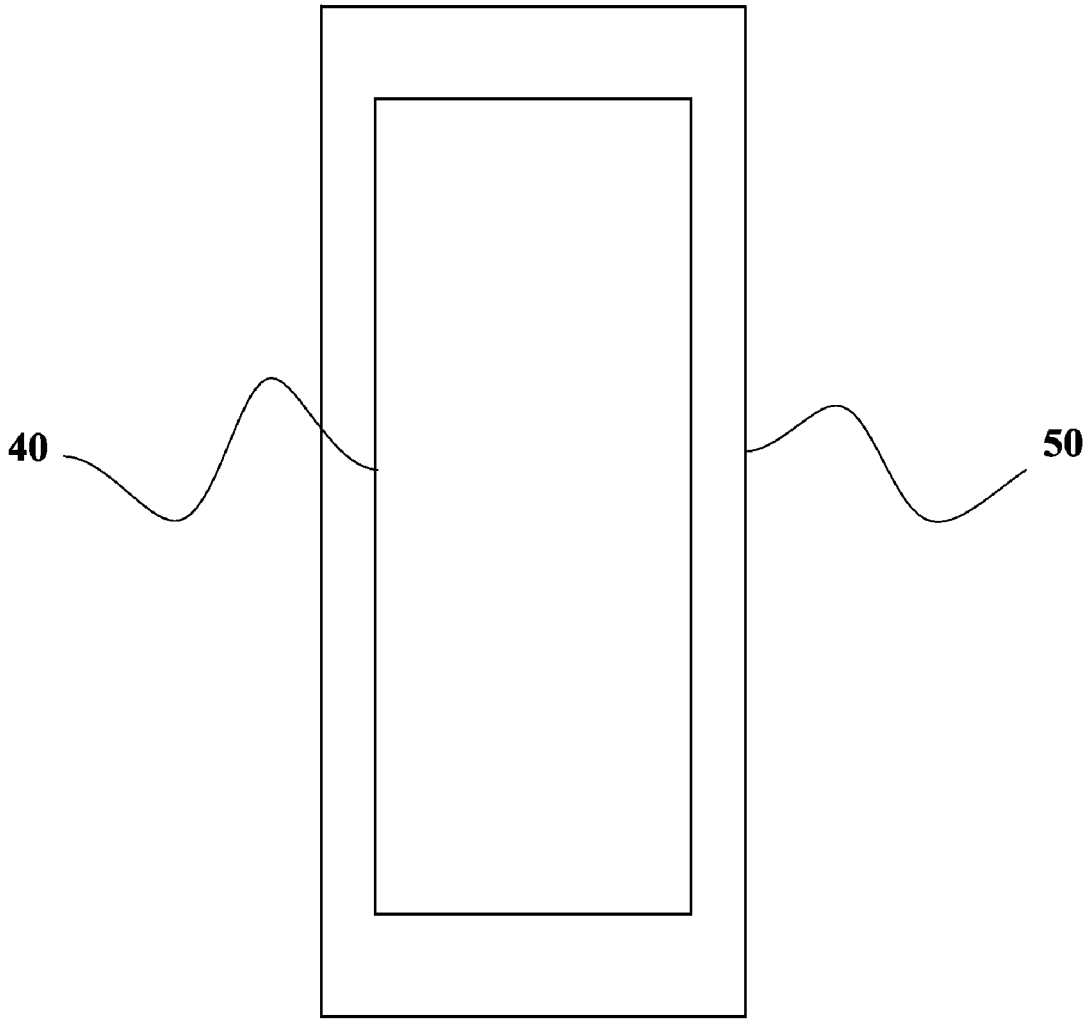
FIG. 15 is a front elevational view of the third preferred embodiment of the invention, showing the base enclosed in a holder.
Figure 16:
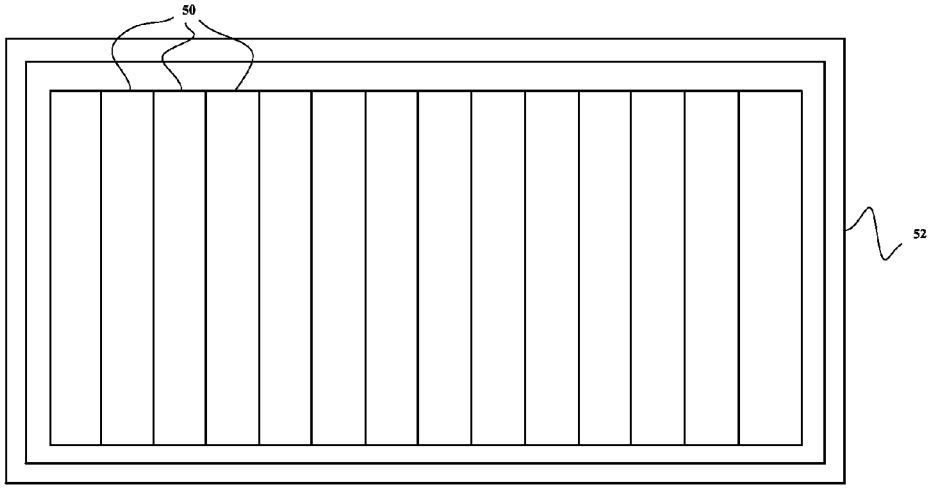
FIG. 16 is a front elevational view of the third preferred embodiment of the invention, showing multiple holders within a case.
Figure 17:
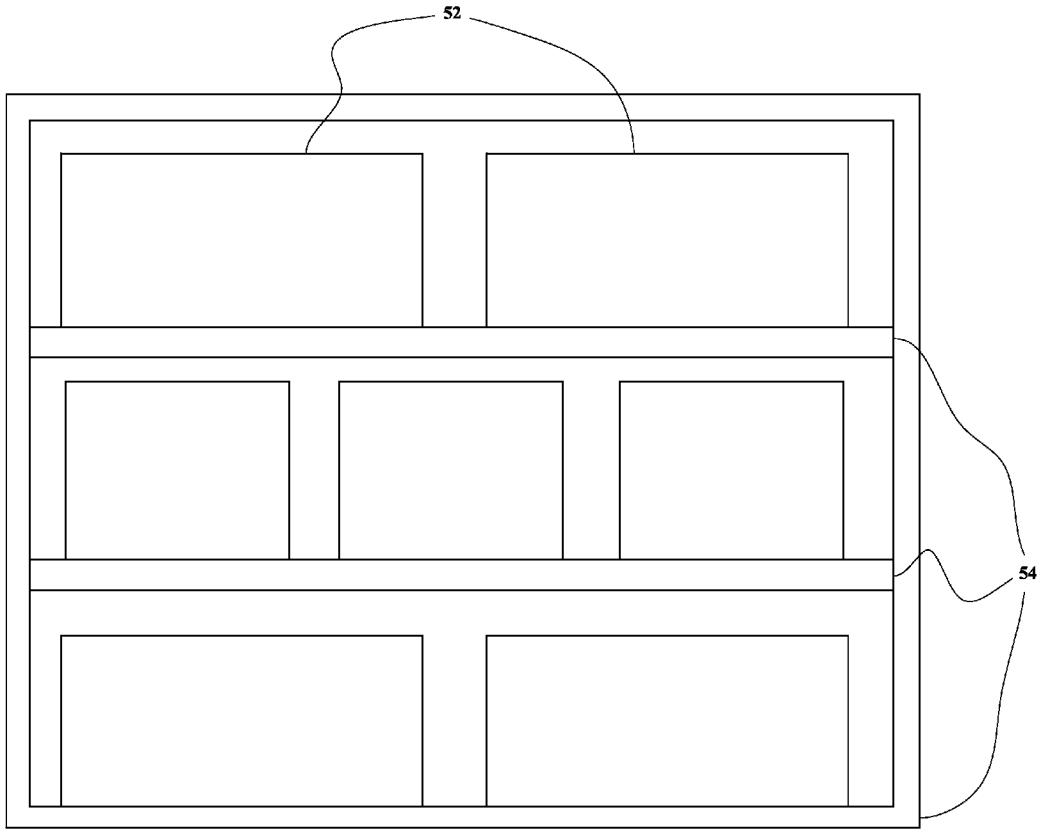
FIG. 17 is a front elevational view of the third preferred embodiment of the invention, showing multiple cases resting on shelves.

Each memorial card may be removably retained in a holder 50 (similar to a "jewel case" for compact discs) as shown in FIG. 15. As many as hundreds of memorial cards in the holders may be stored and removably retained in a memorial holder case 52 as shown in FIG. 16. Memorial holder cases may be stored and removably retained on one or more library shelves 54 as shown in FIG. 17. (Alternatively, memorial cards may be stored in a circular holder similar to a ROLODEX.)

It is to be understood that the present invention is not limited to the embodiments described above, but encompasses any and all embodiments within the scope of the following claims.

I claim:

1. A memorial card, comprising:

a thin rectangular base, having a first unsealed internal rectangular cavity with an opening in a first edge of the base, and a second unsealed internal rectangular cavity with an opening at a second edge of the base opposite to the first edge;

a memory card removably retained within the first internal rectangular cavity, said memory card containing digital information about a deceased individual; and a remains module removably retained within the second internal rectangular cavity, containing ashes of the deceased individual.

2. The memorial card according to claim 1, wherein one or more exterior surfaces of the thin rectangular base are imprinted with information about the deceased individual.

3. The memorial card according to claim 1, wherein one or more exterior surfaces of the thin rectangular base have one or more pictures of the deceased individual.

4. The memorial card according to claim 1, wherein the memory card can be plugged into a port in a computer to retrieve the information about the deceased individual.

5. The memorial card according to claim 1, wherein the memory card contains pictures in digital format.

6. The memorial card according to claim 1, wherein the memory card contains movies in digital format.

7. The memorial card according to claim 1, wherein an identification code is recorded in the base, the memory card and the remains module.

8. The memorial card according to claim 1, further comprising:

a holder in which the memorial card is removably retained.

9. The memorial card according to claim 8, further comprising:

a case within which a plurality of the holders is removably retained; and one or more shelves on which a plurality of the cases is removably retained.

10. The memorial card according to claim 1, wherein the deceased individual is a non-human animal.

11. A memorial card, comprising:

a thin rectangular base, having a first unsealed internal rectangular cavity with an opening in a first edge of the base, and a second unsealed internal rectangular cavity with an opening at a second edge of the base opposite to the first edge;

a memory card removably retained within the first internal rectangular cavity, said memory card containing digital information about a deceased individual; and a remains module removably retained within the second internal rectangular cavity, containing belongings of the deceased individual.

12. The memorial card according to claim 11, wherein one or more exterior surfaces of the thin rectangular base are imprinted with information about the deceased individual.

13. The memorial card according to claim 11, wherein one or more exterior surfaces of the thin rectangular base have one or more pictures of the deceased individual.

14. The memorial card according to claim 11, wherein the memory card can be plugged into a port in a computer to retrieve the information about the deceased individual.

15. The memorial card according to claim 11, wherein the memory card contains pictures in digital format.

16. The memorial card according to claim 11, wherein the memory card contains movies in digital format.

17. The memorial card according to claim 11, wherein an identification code is recorded in the base, the memory card and the remains module.

18. The memorial card according to claim 11, further comprising:

a holder in which the memorial card is removably retained.

19. The memorial card according to claim 18, further comprising:

a case within which a plurality of the holders is removably retained; and one or more shelves on which a plurality of the cases is removably retained.

20. The memorial card according to claim 11, wherein the deceased individual is a non-human animal.

* * * * *